US011235444B2

(12) United States Patent
Muramatsu et al.

(10) Patent No.: US 11,235,444 B2
(45) Date of Patent: Feb. 1, 2022

(54) ROTARY IMPACT TOOL

(71) Applicant: Panasonic Intellectual Property Management Co., Ltd., Osaka (JP)

(72) Inventors: Masari Muramatsu, Mie (JP); Takashi Kusagawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 443 days.

(21) Appl. No.: 15/919,943

(22) Filed: Mar. 13, 2018

(65) Prior Publication Data

US 2018/0272510 A1 Sep. 27, 2018

(30) Foreign Application Priority Data

Mar. 27, 2017 (JP) ..... JP2017-060896

(51) Int. Cl.

| | |
|---|---|
| ***B25B 21/02*** | (2006.01) |
| ***B25F 5/00*** | (2006.01) |
| ***B25D 11/10*** | (2006.01) |
| ***B25D 11/04*** | (2006.01) |

(52) U.S. Cl.

CPC ..... *B25B 21/02* (2013.01); *B25B 21/026* (2013.01); *B25D 11/04* (2013.01); *B25D 11/104* (2013.01); *B25F 5/001* (2013.01); *B25D 2211/065* (2013.01); *B25D 2250/045* (2013.01)

(58) Field of Classification Search

CPC ..... B25B 21/02; B25B 21/026

See application file for complete search history.

(56) References Cited

U.S. PATENT DOCUMENTS

| | | | | |
|---|---|---|---|---|
| 6,491,111 | B1 * | 12/2002 | Livingston | B25B 21/02 173/93 |
| 7,918,286 | B2 * | 4/2011 | Nagasaka | B25B 21/02 173/109 |
| 10,016,881 | B2 | 7/2018 | Aoyagi | |
| 2005/0199404 | A1 * | 9/2005 | Furuta | B25B 21/00 173/48 |
| 2006/0011363 | A1 * | 1/2006 | Chang | B25B 21/02 173/93.5 |

(Continued)

FOREIGN PATENT DOCUMENTS

JP 2014-240108 A 12/2014

OTHER PUBLICATIONS

Japanese Office Action issued in corresponding Japanese Patent Application No. 2017-030896, dated Sep. 1, 2020, with English translation.

*Primary Examiner* — Anna K Kinsaul
*Assistant Examiner* — Daniel Jeremy Leeds
(74) *Attorney, Agent, or Firm* — McDermott Will & Emery LLP

(57) ABSTRACT

A secondary hammer support structure in a rotary impact tool is structured such that a plurality of steel balls are disposed between a secondary hammer and a retaining member. The plurality of steel balls are arranged between the first retaining groove of the secondary hammer and the second retaining groove of the retaining member. The retaining member is formed as a member separate from the spindle and has a retaining surface for retaining steel balls and a mounting surface mounted to the spindle so as not be rotatable. The mounting surface of the retaining member is mounted to a front member of a carrier.

5 Claims, 9 Drawing Sheets

(56) References Cited

U.S. PATENT DOCUMENTS

2006/0144601 A1* 7/2006 Pusateri ..... B25B 21/026
173/1
2007/0267207 A1* 11/2007 Ito ..... B25B 21/02
173/217
2009/0038816 A1* 2/2009 Johnson ..... B25B 21/026
173/109
2012/0000683 A1* 1/2012 Nagasaka ..... B25B 21/023
173/93.5
2012/0073845 A1* 3/2012 Nakamura ..... B25B 21/026
173/93.5
2012/0318548 A1 12/2012 Hirabayashi et al.
2012/0322605 A1* 12/2012 Hirabayashi ..... B25F 5/001
475/149
2013/0032370 A1* 2/2013 Hirabayashi ..... B25D 11/106
173/47
2014/0338942 A1* 11/2014 Putney ..... B25B 21/02
173/93
2014/0367132 A1* 12/2014 Tanaka ..... B25B 21/026
173/93
2015/0158155 A1* 6/2015 Moto ..... B25B 21/02
173/93
2016/0075004 A1* 3/2016 Moto ..... B25B 21/026
173/93
2016/0176027 A1* 6/2016 Aoyagi ..... B25B 21/026
173/93.6

* cited by examiner

ROTARY IMPACT TOOL

CROSS-REFERENCE TO RELATED APPLICATIONS

This application is based upon and claims the benefit of priority of Japanese Patent Application Number 2017-060896, filed on Mar. 27, 2017, the entire contents of which are hereby incorporated by reference.

BACKGROUND

1. Field of the Disclosure

The disclosure relates to a rotary impact tool.

2. Description of the Related Art

JP2014-240108 discloses an impact wrench provided with a spindle configured to be rotated by a driving unit; an anvil arranged in front of the spindle in a direction of a rotational axis of the spindle; and a rotary impact mechanism that transforms rotation of the spindle into rotary impact and transmits the rotary impact to the anvil. The rotary impact mechanism is provided with a primary hammer rotatable around the line of rotational axis of the spindle and movable in the direction of the line of axis, and a secondary hammer accommodating the primary hammer and rotatable with the primary hammer as one piece. A slide bearing that receives a load in the radial direction relative to the line of rotational axis of the spindle is provided between the secondary hammer and the spindle. In the impact wrench disclosed in JP2014-240108, a cam structure in which steel balls are disposed between guide grooves of the spindle and engagement grooves of the primary hammer is provided. The cam structure causes the primary hammer to advance and recede repeatedly at a high speed so as to apply a rotary impact force to the anvil.

In a rotary impact tool in which a primary hammer and a secondary hammer are employed, the magnitude of the impact in the rotational direction is proportional to the total moment of inertia of the primary hammer and the secondary hammer. Meanwhile, the magnitude of the impact in the direction of the line of rotational axis is proportional to the mass of the primary hammer. As compared with a rotary impact tool in which a single hammer having a total mass of the primary hammer and the secondary hammer is used, a rotary impact tool in which a double hammer structure is employed is capable of reducing the magnitude of the impact in the direction of the line of rotational axis, while maintaining the magnitude of the impact in the rotational direction unaffected.

SUMMARY

Various types of rotary impact tools employing a double hammer structure are manufactured and developed, but it has not been possible to use a spindle member in the hammers in common in different types of tools. The capability to use main components commonly leads directly to reduction in the manufacturing cost and the development cost. We have arrived at an idea to realize the capability to use a spindle member commonly by modifying the structure of the spindle member of the related art.

In this background, a purpose of the present disclosure is to provide a technology of using a spindle member in common in a primary hammer and a secondary hammer in a rotary impact tool having the primary hammer and the secondary hammer.

A rotary impact tool according to an embodiment of the present invention includes: a driving unit; a spindle rotated by the driving unit; an anvil disposed in front of the spindle in the direction of the line of rotational axis of the spindle; a primary hammer rotatable around the line of rotational axis of the spindle and movable in the direction of the line of rotational axis; a cam structure in which at least one steel ball is disposed between a guidance groove of the spindle and an engagement groove of the primary hammer; a secondary hammer rotatable with the primary hammer as one piece; a support member that rotatably supports the secondary hammer; and a retaining member that retains the support member. The retaining member is formed as a member separate from the spindle and has a retaining surface for retaining the support member and a mounting surface mounted to the spindle so as not be rotatable.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

One aspect of the invention will now be described by reference to the preferred embodiments. This does not intend to limit the scope of the present invention, but to exemplify the invention.

The rotary impact tool of the embodiment includes a driving unit, a spindle rotated by the driving unit, an anvil disposed in front of the spindle in the direction of the line of rotational axis of the spindle, and a rotary impact mechanism transforming the rotation of the spindle into a rotary impact and transmitting the rotary impact to the anvil. A double hammer structure is employed in the rotary impact mechanism. The rotary impact mechanism includes a primary hammer rotatable around the line of rotational axis of the spindle and movable in the direction of the line of axis, and a secondary hammer accommodating the primary hammer and rotatable with the primary hammer as one piece. The rotary impact mechanism has the function of impulsively engaging the primary hammer with the anvil and rotating the anvil around the line of axis.

Figure 1:
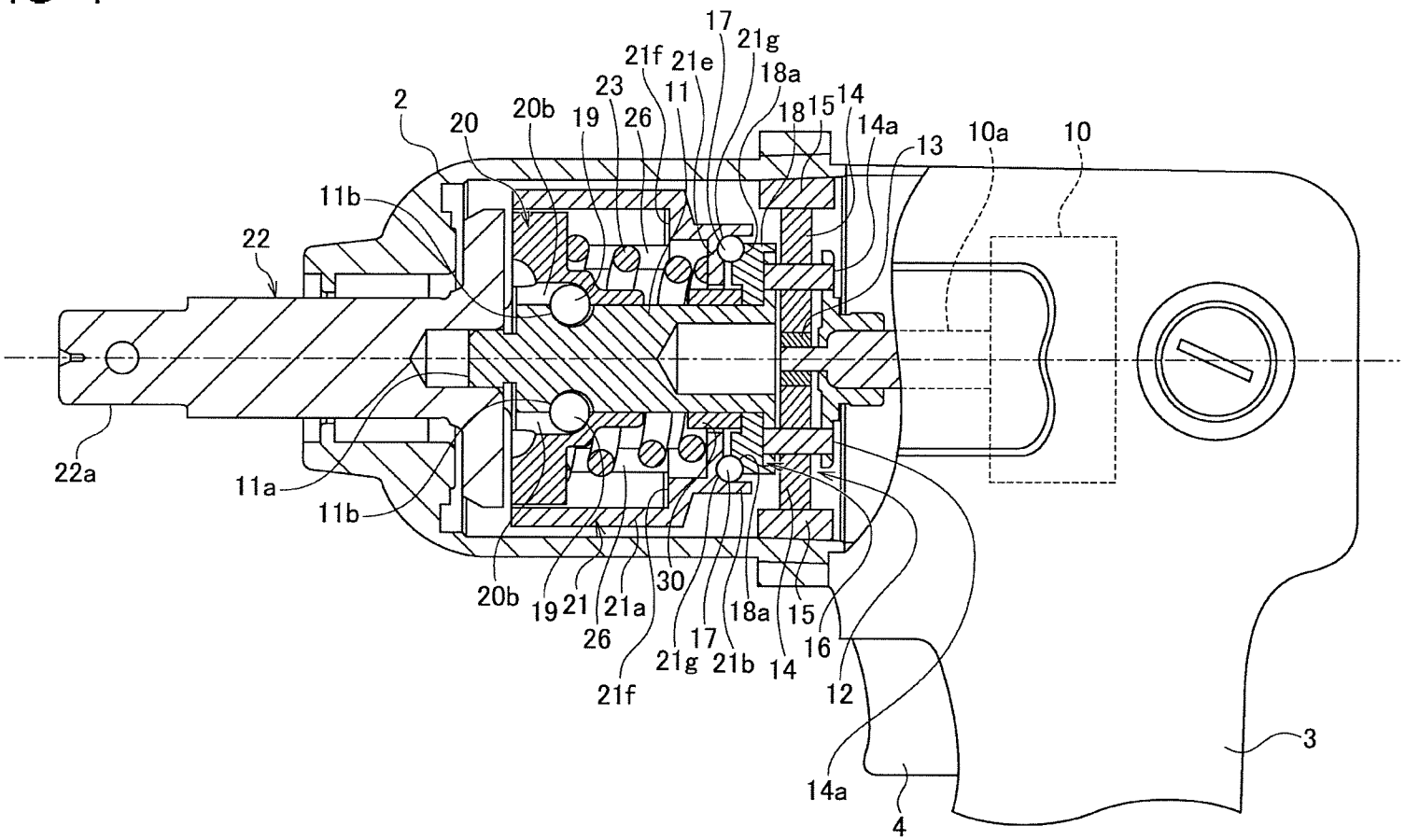
FIG. 1 is a schematic sectional view of a main part of a rotary impact tool according to the embodiment.
Figure 2:
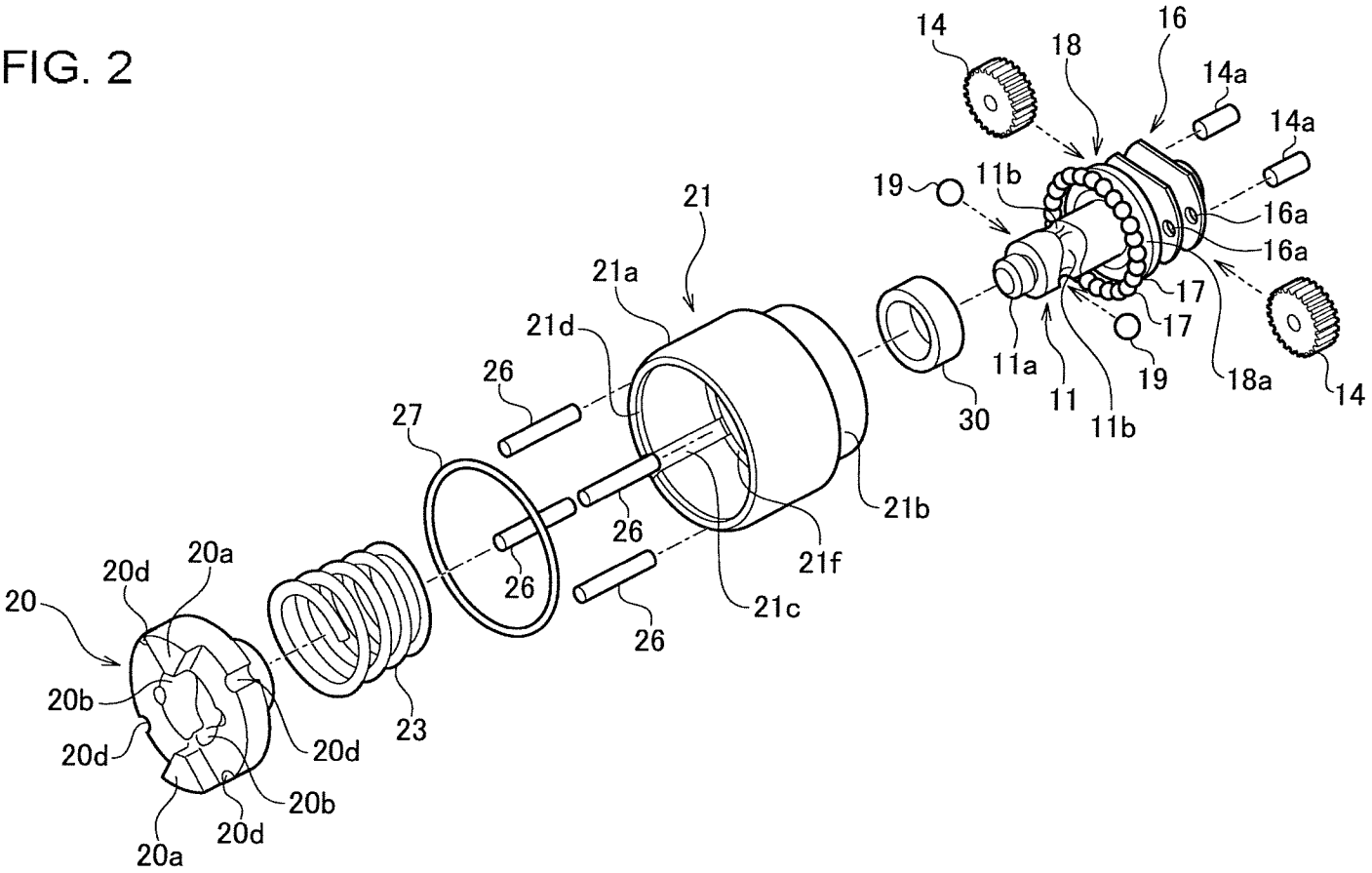
FIG. 2 is an exploded perspective view of components of the rotary impact mechanism according to the embodiment.
Figure 3:
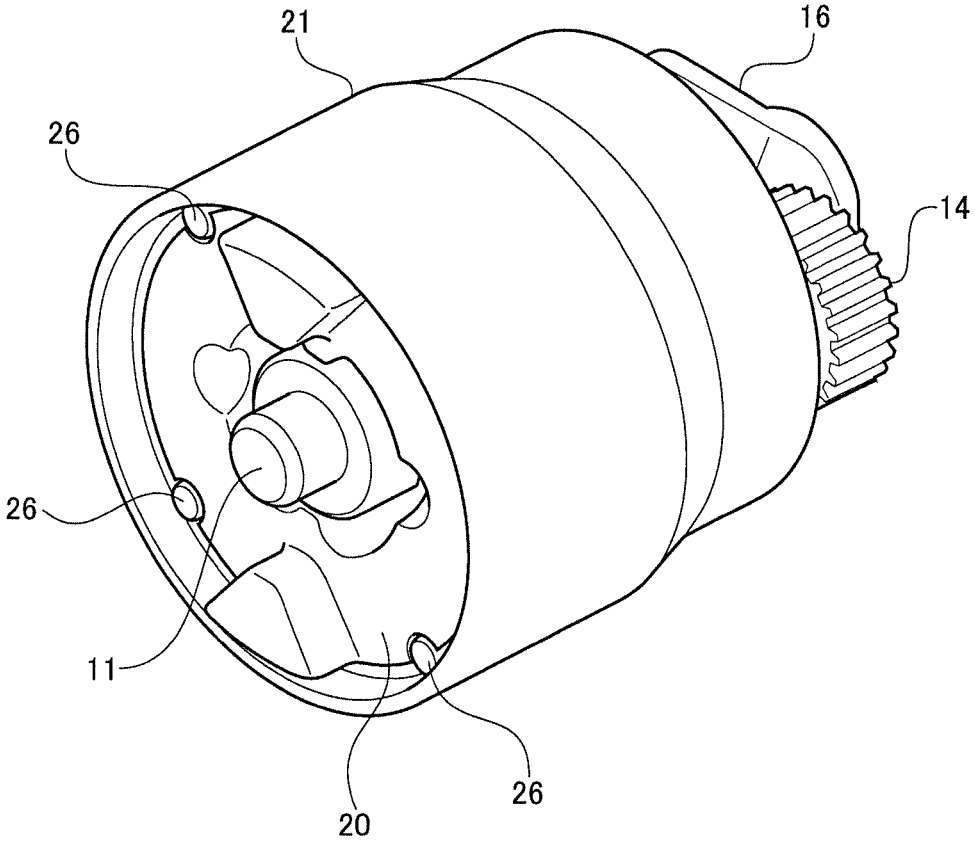
FIG. 3 is a perspective view of an assembly of the rotary mechanism tool according to the embodiment.
Figure 4B:
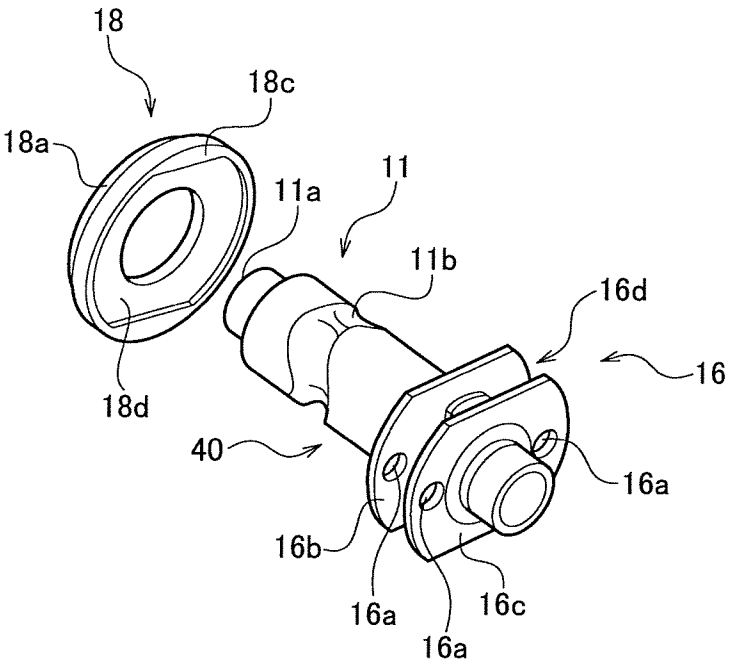
FIGS. 4A and 4B are perspective views of a spindle member and a retaining member.
Figure 4A:
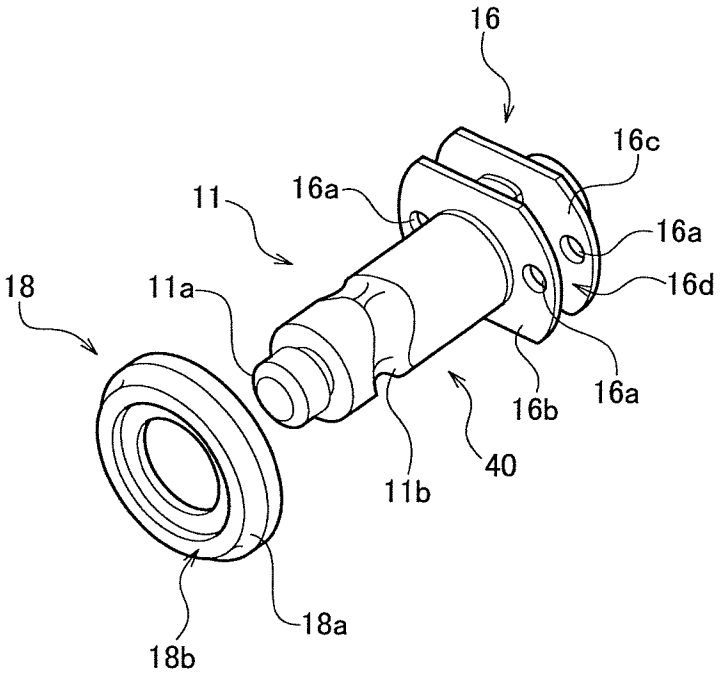
Figure 5C:
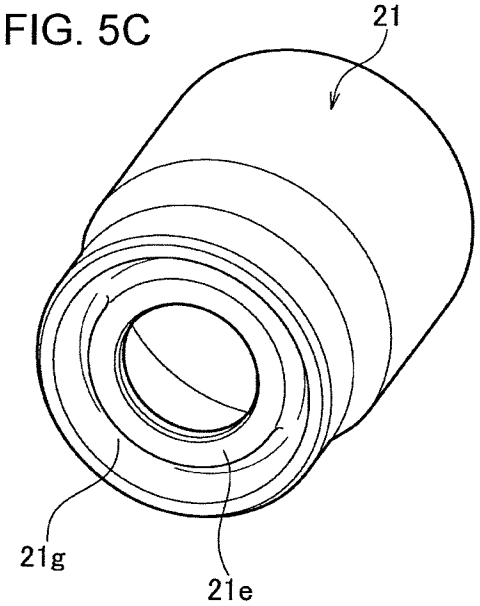
FIG. 5C is a rear perspective view of a secondary hammer.
Figure 5B:
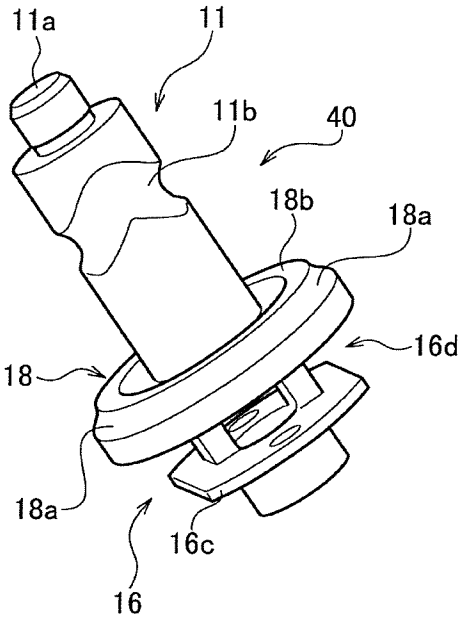
FIG. 5B is a perspective view of the spindle member to which the retaining member is mounted so as not to be rotatable.
Figure 5A:
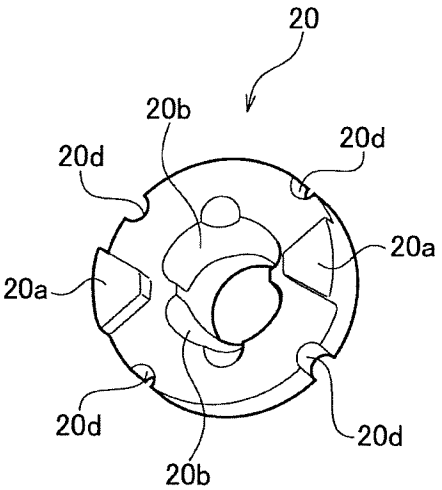
FIG. 5A is a front perspective view of a primary hammer.

FIG. 1 is a schematic sectional view of a main part of a rotary impact tool according to the embodiment. Referring to FIG. 1, the dashed line indicates a line of rotational axis of the rotary impact tool 1. FIG. 2 is an exploded perspective view of components of the rotary impact mechanism according to the embodiment, and FIG. 3 is a perspective view of an assembly of the rotary impact mechanism according to the embodiment. FIGS. 4A and 4B are perspective views of a spindle member and a retaining member. FIG. 5A is a front perspective view of a primary hammer, FIG. 5B is a perspective view of the spindle member to which the retaining member is mounted so as not to be rotatable, and FIG. 5C is a rear perspective view of a secondary hammer. In FIGS. 1 and 3, illustration of a stopper member 27 described later is omitted. A description will be given of the structure of the rotary impact tool 1 with reference to FIGS. 1-5C.

The rotary impact tool 1 includes a housing 2 that constitutes a tool main body. The upper part of the housing 2 forms a space for accommodating various components, and the lower part of the housing 2 constitutes a grip 3 gripped by a user. On the frontal side of the grip 3 is provided a user operation switch 4 controlled by the finger of the user. At the lower end of the grip 3 is provided a battery (not shown) for supplying electric power to the driving unit 10.

The driving unit 10 is an electrically-driven motor. A driving shaft 10*a* of the driving unit 10 is coupled via a power transmission mechanism 12 to a spindle member 40 in which a carrier 16 and a spindle 11 are integrated. The carrier 16 is located toward the rear end of the spindle 11 and accommodates gears for transmission of power. Referring to FIGS. 4A and 4*b*, the carrier 16 has a front member 16*b* and a rear member 16*c* located behind the front member 16*b*. Between the front member 16*b* and the rear member 16*c* is formed a space 16*d* for accommodating the gears. The front member 16*b* and the rear member 16*c* are formed with a plurality of through holes 16*a* in which support shafts 14*a* for rotatably supporting the gears are inserted. The front member 16*b* and the rear member 16*c* are plate members having a bilaterally D-cut shape. The through holes 16*a* are formed in the arc shaped part.

The power transmission mechanism 12 has a sun gear 13 press-fitted and fixed to the end of the driving shaft 10*a*, two planetary gears 14 engaged with the sun gear 13, and an internal gear 15 engaged with the planetary gears 14. The internal gear 15 is fixed to the inner circumferential surface of the housing 2. The planetary gears 14 are rotatably supported by the support shafts 14*a* inserted through the through holes 16*a* of the front member 16*b* and of the rear member 16*c* in the space 16*d* of the carrier 16. A bearing may be disposed on the rear surface of the rear member 16*c* so that the bearing functions as a retainer of the support shafts 14*a*.

The power transmission mechanism 12 constituted as described above decelerates the rotation of the driving shaft 10*a* in accordance with the ratio between the number of teeth of the sun gear 13 and the number of teeth of the internal gear 15 and increases the rotary torque of the rotation. This can drive the spindle member 40 with a low speed and a high torque.

The rotary impact mechanism of the rotary impact tool 1 is constituted by the spindle member 40, a primary hammer 20, a secondary hammer 21, and a spring member 23. The spindle 11 is column-shaped. A small-diameter projection 11*a* is formed at the end of the spindle 11 so as to be coaxial with the spindle 11. The projection 11*a* is rotatably inserted into a hole having a columnar internal space formed in the rear part of the anvil 22.

The primary hammer 20 made of steel that is substantially disc-shaped and formed with a through hole at the center is fitted to the outer circumference of the spindle 11. A pair of hammer claws 20*a* projecting toward the anvil 22 are formed on the front face of the primary hammer 20. The primary hammer 20 is fitted to the spindle 11 so as to be rotatable around the rotational axis of the spindle 11 and movable in the direction of the line of rotational axis of the spindle 11, i.e., the front-back direction. This allows the primary hammer 20 to apply a rotary impact force to the anvil 22. The secondary hammer 21 is formed as a cylindrical member made of steel and is segmented into a front part 21*a* and a rear part 21*b* by an annular partition 21*e*. The secondary hammer 21 accommodates the primary hammer 20 in the internal space of the front part 21*a*.

The secondary hammer 21 and the primary hammer 20 include a unitary rotation mechanism that rotates them as one piece. Referring to FIG. 2, the outer circumferential surface of the primary hammer 20 includes four first pin grooves 20*d* having a semi-circular cross section and parallel to the line of rotational axis of the spindle 11. The inner circumferential surface of front part 21*a* of the secondary hammer 21 includes four second pin grooves 21*c* having a semicircular cross section and parallel to the line of rotational axis of the spindle 11. The four second pin grooves 21*c* of the secondary hammer 21 are formed at positions aligned with the four first pin grooves 20*d* of the primary hammer 20. The first pin grooves 20*d* may be formed at the intervals of 90° in the outer circumferential surface of the primary hammer 20. When this is the case, the second pin grooves 21*c* are formed at the intervals of 90° in the inner circumferential surface of the secondary hammer 21.

Engagement pins 26 that are columnar members are disposed in the second pin grooves 20*c*. The engagement pins 26 may be needle rollers. The engagement pins 26 are inserted into the second pin grooves 21*c* from the front end of the secondary hammer 21 as far as the groove bottoms provided in step parts 21*f* that project from the inner circumference. In the state that the engagement pins 26 are inserted as far as the groove bottoms, a stopper member 27 that has the function of preventing the engagement pins 26 from being dislodged is set in an annular groove 21*d* formed on the inner circumferential surface of the secondary hammer 21. By disposing the stopper member 27 in the annular groove 21*d*, the movement of the engagement pins 26 in the second pin grooves 21*c* is restricted.

In an assembly process, in the state that the four engagement pins 26 are fitted in the four second pin grooves 21*c* of the secondary hammer 21, the four first pin grooves 20*d* of the primary hammer 20 and the four engagement pins 26 are aligned with each other, and the primary hammer 20 is inserted into the secondary hammer 21. This allows the primary hammer 20 and the secondary hammer 21 to be rotatable as one piece around the line of rotational axis of the spindle 11.

The spring member 23 is interposed between the rear part of the primary hammer 20 and the annular partition 21*e* of the secondary hammer 21. The primary hammer 20 is movable in the front-back direction, guided by the engagement pins 26, and is capable of applying a rotary impact force to the anvil 22 by the biasing force of the spring member 23.

The outer circumferential surface of the spindle 11 includes two guide grooves 11*b*, and the inner circumferential surface of the through hole of the primary hammer 20 includes two engagement grooves 20*b*. The two guide grooves 11*b* have the identical shape and are arranged in the circumferential direction, and the two engagement grooves 20*b* have the identical shape and are arranged in the circumferential direction. In the state that the primary hammer 20 is fitted to the outer circumference of the spindle 11, steel balls 19 are disposed between the guide grooves 11*b* and the engagement grooves 20*b*. The guide grooves 11*b* of the spindle 11, the engagement grooves 20*b* of the primary hammer 20, and the steel balls 19 disposed therebetween constitute a "cam structure". The two steel balls 19 support the primary hammer 20 in the radial direction so that the primary hammer 20 is rotatable around the line of rotational axis of the spindle 11 and movable in the direction of the line of rotational axis.

In the cam structure, the guide grooves 11*b* are formed to have a V shape or a U shape as viewed from the end of the tool. In other words, the guide grooves 11*b* include two inclined grooves symmetrically inclined from the forefront part in the diagonally rearward direction. The engagement grooves 20*b* are formed to have an inverted V shape or an inverted U shape as viewed from the end of the tool. As the steel balls 19 move from the forefront part of the guide grooves 11*b* along the inclined grooves, the primary hammer 20 will recede in relation to the spindle 11.

The rear surface of the annular partition 21*e* of the secondary hammer 21 includes an annular first retaining groove 21*g*. The frontal outer circumference of the retaining member 18 fitted to the spindle 11 so as not be rotatable includes an annular second retaining groove 18*a*. FIGS. 4A and 4B show a state occurring before the retaining member 18 is fitted to the spindle member 40. FIG. 5B shows a state occurring after the retaining member 18 is fitted to the spindle member 40.

A plurality of steel balls 17 are closely arranged in the circumferential direction between the first retaining groove 21*g* and the second retaining groove 18*a*. The steel balls 17 may be formed to be smaller than the steel balls 19. The first retaining groove 21*g* of the secondary hammer 21, the second retaining groove 18*a* of the retaining member 18, and the steel balls 17 closely arranged therebetween constitute a "secondary hammer support structure". The steel balls 17 are support members that rotatably support the secondary hammer 21 in the secondary hammer support structure. The retaining member 18 supports the steel balls 17 so that the steel balls 17 receive a load in a direction different from the direction of the line of rotational axis of the spindle 11 or the direction perpendicular to the direction of the line of rotational axis.

The retaining member 18 is formed as a member separate from the spindle member 40 in which the spindle 11 and the carrier 16 are integrated. The retaining member 18 has a retaining surface 18*b* that supports the steel balls 17, which are support members of the secondary hammer 21, and a mounting surface 18*c* mounted to the spindle 11 so as not be rotatable relative to the spindle 11. As described above, the second retaining groove 18*a* is formed on the outer circumference of the retaining surface 18*b*. The mounting surface 18*c* is mounted to the front member 16*b* so as not be rotatable.

The mounting surface 18*c* may have a shape that can be fitted to the front member 16*b* and may be mounted by being fitted to the front member 16*b*. The mounting surface 18*c* may be formed with a fitting part 18*d* that is a recess conforming to the bilaterally D-cut shape of the front member 16*b*, and the front member 16*b* may be press-fitted to the fitting part 18*d*. This ensures that the retaining member 18 is mounted so as not to be rotatable relative to the spindle 11.

In the embodiment, the steel balls 17 rotatably support the secondary hammer 21. Alternatively, a slide bearing may rotatably support the secondary hammer 21, as disclosed in JP2014-24108. In this case, the rear surface of the annular partition 21*e* of the secondary hammer 21 is formed with a first retaining groove for retaining the outer ring of the bearing, and the outer circumference of the retaining surface 18*b* of the retaining member 18 is formed with a second retaining groove for retaining the inner ring of the bearing.

Regardless of whether the secondary hammer 21 is supported by the steel balls 17 or the slide bearing, there is no need to modify the spindle member 40. In other words, the spindle member 40 of the rotary impact tool 1 of the embodiment can be used in common regardless of the type of the support member of the secondary hammer 21, because the retaining member 18 separate from the spindle member 40 retains the support member of the secondary hammer 21.

Thus, by forming the retaining member 18 so as to be separate from the spindle member 40 in the rotary impact tool 1 of the embodiment, the retaining member 18 can be used to modify the support member of the secondary hammer 21 or adjust the torque characteristics without changing the spindle member 40. In the related art, it was necessary to change the spring member 23 in order to, for example, change the spring load on the primary hammer 20. In the rotary impact tool 1 of the embodiment, it is possible to change the spring load by adjusting the thickness of the retaining member 18 in the direction of the line of axis, while using the same spring member 23. In this case, not only the spindle member 40 can be used in common but also the spring member 23 can be used in common.

A stopper member 30 is provided between the primary hammer 20 and the retaining member 18 and restricts the range of movement of the primary hammer 20 in the direction of the line of rotational axis so as to prevent the steel balls 19 in the cam structure from colliding with the end of the tilted groove. The stopper member 30 may be made of, for example, a resin material.

The anvil 22 engaged with the primary hammer 20 is made of steel and is rotatably supported by the housing 2 via a slide bearing that is made of steel or brass. The end of the anvil 22 includes a tool mounting part 22*a* having a square cross section to which a socket body that is to be mounted on the head of a hexagon bolt or hexagon nut is fitted.

The rear part of the anvil 22 includes a pair of anvil claws configured to be engaged with the pair of hammer claws 20*a* of the primary hammer 20. The pair of anvil claws are each formed as a columnar member having a fan-shaped cross section. The number of anvil claws of the anvil 22 or the hammer claws 20*a* of the primary hammer 20 need not be two, and three or more claws may be provided in the circumferential direction of the anvil 22 or the primary hammer 20 at regular distances as long as the number of claws are equal to each other.

A description will now be given of the operation of the cam structure of the rotary impact tool 1 according to the embodiment. When the driving unit 10 is driven into rotation as the user pulls the user operation switch 4, the carrier 16 and the spindle 11 are rotated via the power transmission mechanism 12. The rotational force of the spindle 11 is transmitted to the primary hammer 20 via the steel balls 19 set between the guide grooves 11*b* of the spindle 11 and the engagement grooves 20*b* of the primary hammer 20, causing the primary hammer 20 and the secondary hammer 21 to be rotated as one piece.

Figure 6A:
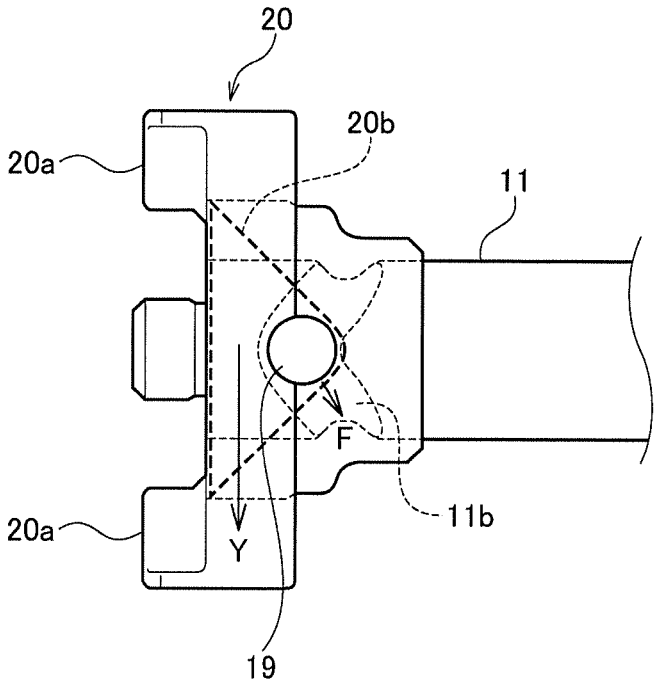
FIGS. 6A and 6B show operating states of a cam structure.
Figure 6B:
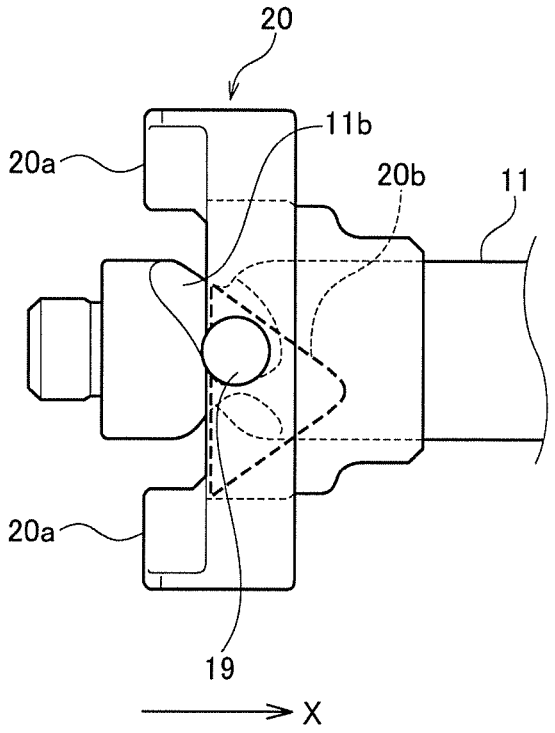

FIG. 6A shows a state of the cam structure occurring immediately after a bolt or nut is started to be tightened, and FIG. 6B shows a state occurring after an elapse of a time since the bolt or nut started to be tightened. FIG. 6B shows a comparison with the initial state of the cam structure shown in FIG. 6A and illustrates the steel balls 19 moving from the forefront part of the guide grooves 11*b* to the groove ends.

Figure 7A:
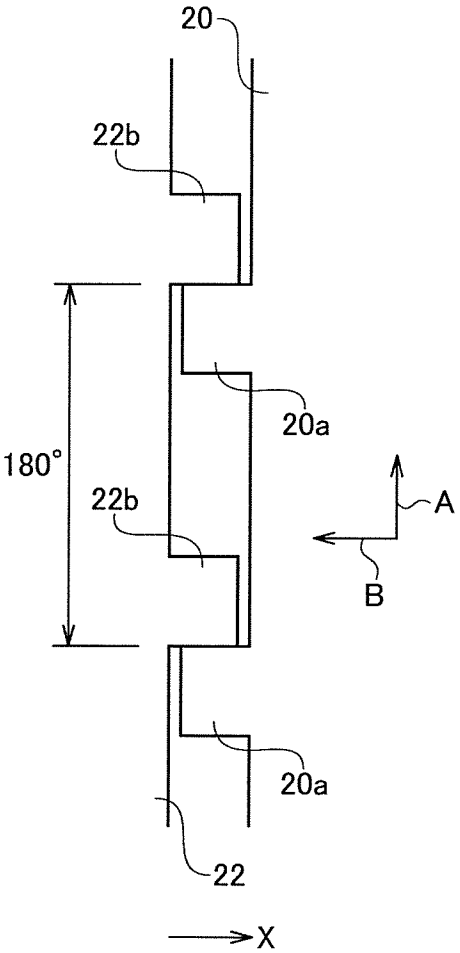
FIGS. 7A-7C schematically show relative positions of surfaces of engagement between the primary hammer and the anvil developed in the circumferential direction.
Figure 7B:
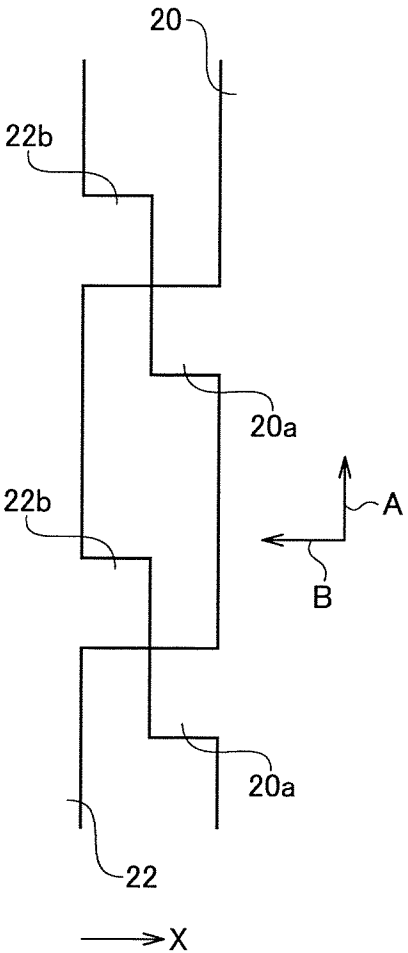
Figure 7C:
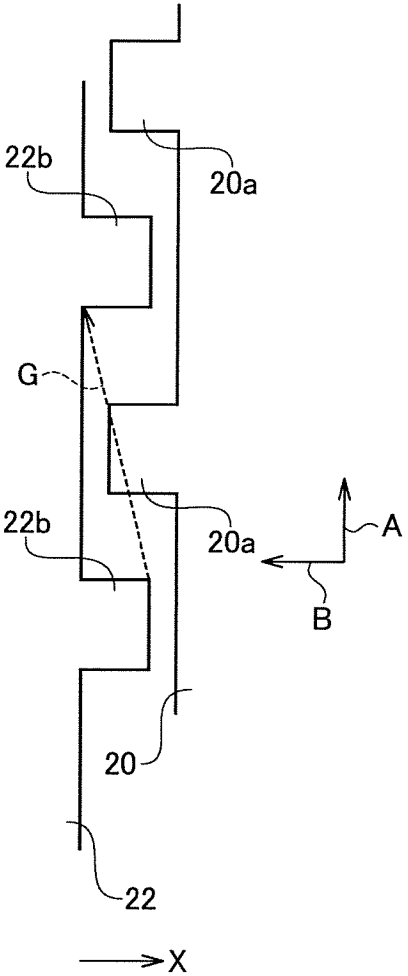

FIGS. 7A-7C schematically show relative positions of surfaces of engagement between the primary hammer 20 and the anvil 20 developed in the circumferential direction. FIG. 7A shows a state of engagement between the hammer claws 20*a* of the primary hammer 20 and the anvil claws 22*b* of the anvil 22 occurring immediately after a bolt or nut is started to be tightened.

As shown in FIGS. 7A-7C, a rotational force A from the rotation of the driving unit 10 is applied to the primary hammer 20 in the direction indicated by the arrow. Further, a biasing force B in the advancing direction is applied by the spring member 23 to the primary hammer 20 in the direction indicated by the arrow.

As the primary hammer 20 is rotated, the engagement between the hammer claws 20*a* and the anvil claws 22*b* in the circumferential direction causes the rotational force of the primary hammer 20 to be transmitted to the anvil 22. The rotation of the anvil 22 causes the socket body (not shown) attached to the tool mounting part 22*a* to rotate, giving the bolt or nut a rotational force and performing initial tightening. Since the spring member 23 applies the biasing force B to the primary hammer 20, the steel balls 19 are located at the forefront part in the guide grooves 11*b*, as shown in FIG. 6A. In this state, the hammer claws 20*a* and the anvil claws 22*b* are engaged with each other over the maximum length.

When the load torque applied to the anvil 22 increases as the tightening of the bolt or nut proceeds, a rotational force in the Y-direction is generated in the primary hammer 20. When the load torque exceeds a predetermined value, the steel balls 19 move in the direction indicated by the arrow F along the inclined surfaces of the guide grooves 11*b* and the engagement grooves 20*b* against the biasing force B applied by the spring member 23, causing the primary hammer 20 to move in the receding direction (X direction).

When the steel balls 19 move in the inclined grooves until the primary hammer 20 has moved in the X direction over the maximum length of engagement between the hammer claws 20*a* and the anvil claws 22*b*, the hammer claws 20*a* are disengaged from the anvil claws 22*b* as shown in FIG. 7B.

When the hammer claws 20*a* are disengaged from the anvil claws 22*b*, the biasing force B of the compressed spring member 23 is released and thereby the primary hammer 20 advances at a high speed while rotating in the direction in which the rotational force A is applied.

Then, as shown in FIG. 7C, the hammer claws 20*a* move along the track indicated by the arrow G and collide with the anvil claws 22*b*, applying an impact force in the rotational direction to the anvil 22. Thereafter, the hammer claws 20*a* is moved by the reaction in the direction opposite to that of the track G but eventually returns to the state shown in FIG. 7A by the rotational force A and the biasing force B. The above-described action is repeated at a high speed so that a rotary impact force is repeatedly applied by the primary hammer 20 to the anvil 22.

Although the operation of tightening a bolt or nut has been described above, a similar operation as that of tightening is performed by the rotary impact mechanism to loosen a tightened bolt or nut. In that case, however, the rotation of the driving unit 10 in the direction opposite to that of tightening causes the steel balls 19 to move to the upper right along the guide grooves 11*b* shown in FIG. 6A and causes the hammer claws 20*a* to strike the anvil claws 22*b* in the direction opposite to that of tightening.

Figure 8:
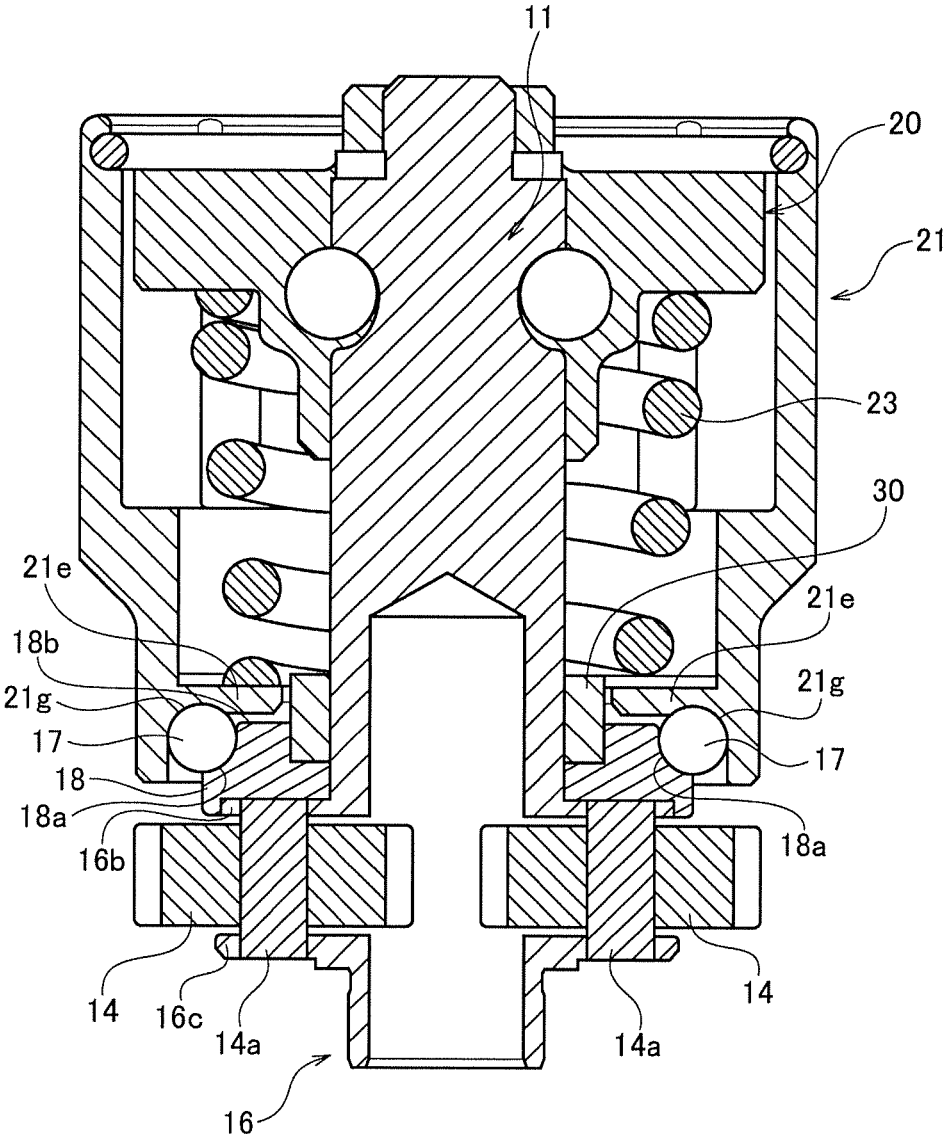
FIG. 8 shows an example of the retaining member in the secondary hammer support structure.

FIG. 8 shows an example of the retaining member in the secondary hammer support structure. The secondary hammer support structure is structured such that a plurality of steel balls 17 are arranged between the secondary hammer 21 and the retaining member 18.

The rear surface of the annular partition 21*e* of the secondary hammer 21 includes the annular first retaining groove 21*g* for retaining the steel balls 17. The cross section of the first retaining groove 21*g* in the direction of the line of rotational axis is arc-shaped, and the cross-sectional radius of the first retaining groove 21*g* is larger than the radius of the steel balls 17. Further, the outer circumference of the retaining surface 18*b* of the retaining member 18 includes the annular second retaining groove 18*a* for retaining the steel balls 17. The cross section of the second retaining groove 18*a* in the direction of the line of rotational axis is arc-shaped, and the cross-sectional radius of the second retaining groove 18*a* is larger than the radius of the steel balls 17.

By forming the first retaining groove 21*g* and the second retaining groove 18*a* in this way and sandwiching the steel balls 17 between the first retaining groove 21*g* and the second retaining groove 18*a*, the steel balls 17 are in contact with the first retaining groove 21*g* and the second retaining groove 18*a* stably and properly. This allows the steel balls 17 as support members to support the secondary hammer 21 suitably. The steel balls 17 are arranged between the first retaining groove 21*g* and the second retaining groove 18*a* so that the steel balls 17 receive a load in a direction different from the direction of the line of rotational axis and the radial direction of the spindle 11. In the rotary impact tool 1, the rotary impact from the rotary impact mechanism produces a load in the direction of the line of rotational axis and in the radial direction. The secondary hammer support structure of the embodiment is configured to be compact by allowing the plurality of steel balls 17 to receive a load in a direction different from the direction of the line of rotational axis and the radial direction.

Described above is an explanation based on an exemplary embodiment. The embodiment is intended to be illustrative only and it will be understood by those skilled in the art that various modifications to constituting elements and processes could be developed and that such modifications are also within the scope of the present invention.

Figure 9:
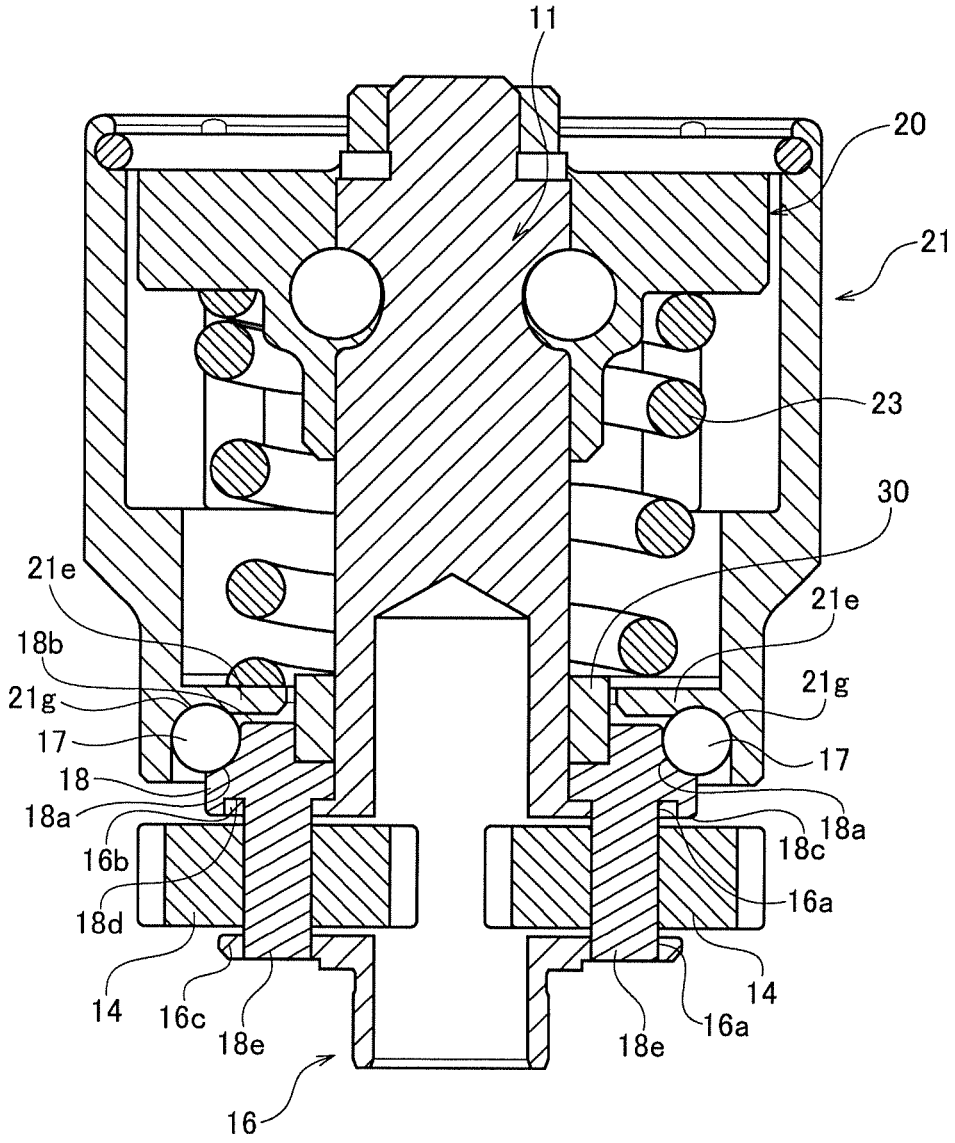
FIG. 9 shows a variation of the retaining member in a secondary hammer support structure.

FIG. 9 shows a variation of the retaining member 18. The mounting surface 18*c* of the retaining member 18 includes a plurality of protrusions 18*e* formed in alignment with the plurality of through holes 16*a* of the front member 16*b* and the rear member 16*c*. The plurality of protrusions 18*e* are rod-shaped members having a circular cross section that hang from the mounting surface 18*c*. The protrusions 18*e* are inserted in the through holes 16*a* and function as support shafts that rotatably support the planetary gears 14 and also function as members that fit the retaining member 18 to the carrier 16 so as not to be rotatable. The protrusions 18*e* may be press-fitted to the through holes 16*a*. The retaining member 18 shown in FIG. 9 has the fitting part 18*d* configured as a recess and fitted to the front member 16*b*.

Alternatively, the rotation may be restricted by the plurality of protrusions 18*e* and without providing the fitting part 18*d*.

In the variation shown in FIG. 9, the protrusions 18*e* may be formed to have a length such that the protrusions 18*e* are press-fitted only to a certain depth of the through holes 16*a* of the front member 16*b*. In this case, the support shafts 14*a* may be inserted as described in the embodiment in the remainder of the through holes 16*a* of the front member 16*b* and in the through holes 16*a* of the rear member 16*c*. The mounting surface 18*c* of the retaining member 18 and the spindle member 40 may be fixed by welding or the like.

The embodiments may be defined by the following items.

A rotary impact tool (1) of an embodiment of the present invention includes a driving unit (10), a spindle (11) rotated by the driving unit, an anvil (22) disposed in front of the spindle in the direction of the line of rotational axis of the spindle, a primary hammer (20) rotatable around the line of rotational axis of the spindle and movable in the direction of the line of rotational axis, a cam structure in which at least one steel ball (19) is disposed between a guidance groove (11*b*) of the spindle and an engagement groove (20*b*) of the primary hammer, a secondary hammer (21) rotatable with the primary hammer as one piece, a support member (17) that rotatably supports the secondary hammer, and a retaining member (18) that retains the support member. The retaining member (18) is formed as a member separate from the spindle (11) and has a retaining surface (18*b*) for retaining the support member (17) and a mounting surface (18*c*) mounted to the spindle (11) so as not be rotatable.

A carrier (16) that accommodates gears (14) for transmission of power between a front member (16*b*) and a rear member (16*c*) may be provided at a rear end of the spindle (11), and the mounting surface (18*c*) may be mounted to the front member (16*b*).

The mounting surface (18*c*) may have a shape that can be fitted to the front member (16*b*).

The mounting surface (18*c*) has a recess (18*d*), and the front member (16*b*) may be press-fitted to the recess.

The front member (16*b*) may be formed with a plurality of through holes (16*a*) in which support shafts (14*a*) for rotatably supporting the gears (14) are inserted, and the mounting surface (18*c*) may have a plurality of protrusions (18*e*) inserted in the plurality of through holes. The protrusions (18*e*) may be press-fitted to the through holes (16*a*).

The retaining surface (18*b*) may retain steel balls or bearings as the support member.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A rotary impact tool comprising:

a driving unit;

a spindle rotated by the driving unit;

an anvil disposed in front of the spindle in a direction of a line of rotational axis of the spindle;

a primary hammer rotatable around the line of rotational axis of the spindle and movable in the direction of the line of rotational axis;

a cam structure in which at least one steel ball is disposed between a guidance groove of the spindle and an engagement groove of the primary hammer;

a secondary hammer rotatable with the primary hammer as one piece;

a support member that rotatably supports the secondary hammer;

a retaining member that retains the support member; and a carrier positioned at a rear end of the spindle and including a front member and a rear member, wherein gears for transmission of power are arranged between the front member and the rear member, wherein the retaining member is separate from the spindle and has a retaining surface for retaining the support member, a retaining groove formed on an outer circumference of the retaining surface, and a mounting surface contacting the carrier, the retaining surface is on a first side of the retaining member and the mounting surface is on a second side of the retaining member, the first side is axially opposite the second side, and the mounting surface includes a recess having a shape that corresponds to a shape of the front member and the front member is received within the recess such that the carrier is coupled to the mounting surface and the retaining member and the spindle rotate together.

2. The rotary impact tool according to claim 1, wherein the front member is press-fitted in the recess.

3. The rotary impact tool according to claim 1, wherein the front member is formed with a plurality of through holes in which support shafts for rotatably supporting the gears are inserted, and the mounting surface has a plurality of protrusions inserted in the plurality of through holes.

4. The rotary impact tool according to claim 3, wherein the protrusions are press-fitted to the through holes.

5. The rotary impact tool according to claim 1, wherein the support member is a steel ball or a bearing and are located in the retaining groove.

* * * * *